United States Patent [19]

Tippin

[11] 4,106,316

[45] Aug. 15, 1978

[54] KEYLESS COMBINATION LOCKS

[75] Inventor: Arthur D. Tippin, Tamworth, England

[73] Assignee: Chubb & Son's Lock and Safe Company Limited, London, England

[21] Appl. No.: 772,025

[22] Filed: Feb. 25, 1977

[30] Foreign Application Priority Data

Mar. 11, 1976 [GB] United Kingdom ..... 9844/76

[51] Int. Cl.[2] ..... E05B 43/00; E05B 37/08

[52] U.S. Cl. ..... 70/268; 70/303 A; 70/333 R

[58] Field of Search ..... 70/1.5, 1.7, 267, 268, 70/303 A, 333 R

[56] References Cited

U.S. PATENT DOCUMENTS

| | | | |
|---|---|---|---|
| 1,626,106 | 4/1927 | Tibbetts | 70/304 |
| 2,029,272 | 1/1936 | Miller | 70/268 |
| 2,575,674 | 11/1951 | Miller | 70/333 R |
| 2,879,657 | 3/1959 | Eichberg | 70/267 |
| 3,176,486 | 4/1965 | Richardson | 70/333 R X |
| 3,702,551 | 11/1972 | Blizzard | 70/303 A X |
| 3,786,658 | 1/1974 | Swaim | 70/333 R |
| 3,906,761 | 9/1975 | Swaim | 70/333 R |

FOREIGN PATENT DOCUMENTS

| | | | |
|---|---|---|---|
| 159,448 | 10/1954 | Australia | 70/303 A |

*Primary Examiner*—Roy D. Frazier
*Assistant Examiner*—Thomas J. Holko
*Attorney, Agent, or Firm*—Andrus, Sceales, Starke & Sawall

[57] ABSTRACT

A keyless combination lock is protected against manipulation by the inclusion of a rotary member turned by rotation of the dial of the lock and which, after excessive rotation from a datum position, such as is likely to occur under conditions of manipulation, serves to move a protective member into an operative position such that operation of the lock is impossible, e.g. by isolating the probe of the lock from the combination wheels. The rotary member is also connected to mechanism for returning it to its datum position after a time delay and arrival at the datum position serves to return the protective member back to an inoperative position if it has previously been moved to its operative position. The return mechanism may start to operate as soon as the rotary member is turned from its datum position and may include a spring which is progressively stressed as the rotary member is turned. The stress in the spring then serves to return the rotary member to its datum position at a rate determined by an escapement mechanism.

10 Claims, 4 Drawing Figures

25
23
22
28A
11
51
54
20
60
16
55
53
61
50
48
49
46
44
40
66
35
36
43
12
41
42
45
65

KEYLESS COMBINATION LOCKS

BACKGROUND OF THE INVENTION

1. Field of the Invention

The present invention is directed to combination locks having protection against manipulation.

2. Description of the Prior Art

The manipulation of combination locks is an art which has developed in step with the development of devices fitted to these locks with the object of preventing this manipulation. The term "manipulation" is used in connection with combination locks to mean the continued operation of the dial of the lock through successive steps in alternately opposite directions on a trial basis, as a result of which the manipulator gradually informs himself of the correct combination of the lock and can eventually open it. At each stage in the development of protective devices to prevent manipulation, the manipulator is foiled until he develops techniques or equipment which use some hitherto untried feature for determining the relative location of the probe or "fence" as it is commonly called and the gates in the respective wheels of the lock. One common feature of all manipulation techniques is that many trial diallings are required and the present invention is based on a practical utilisation of this feature to achieve the desired protection.

SUMMARY OF THE PRESENT INVENTION

According to the present invention, a keyless combination lock includes a rotary member which is turned by rotation of the dial of the lock and which, after a predetermined rotation from a datum position serves to move a protective member into an operative position such that operation of the lock is impossible, the rotary member also being connected to mechanism for returning it to its datum position after a time delay, arrival at the datum position serving to return the protective member back to an inoperative position if it has previously been moved to its operative position. As a consequence, the excessive rotation of the dial which almost invariably occurs under conditions of manipulation causes the protective member to be moved to its operative position and it is then impossible for the manipulator to open the lock. After the expiry of the time delay, however, when the protective member has been returned to its inoperative position, it is again possible to open the lock in the normal way.

Generally speaking, the time delay needs to be of the order of several hours, typically about ten hours. Consequently, if the manipulation occurs overnight, as is usually the case, the lock can be operated normally once again soon after the start of the working hours of the authorised operator.

The return mechanism preferably starts to operate as soon as the rotary member is turned from its datum position so that the member then starts to return slowly to this datum position. Accordingly, any rotation of the member resulting from normal operation of the lock is steadily cancelled out and is not cumulative. Under these conditions the lock appears to the operator to behave in an entirely normal way. The only circumstances in which the protective member is brought into action are when an excessive amount of rotation occurs within a relatively short period of time. In theory, this could occur if the lock were to be operated in a legitimate manner a number of times in quick succession, but in practice this can always be avoided.

As an alternative to the return mechanism starting to operate as soon as the rotary member is turned from its datum position, the return mechanism may start to operate only when the protective member has been moved to its operative position. Rotation of the rotary member is then cumulative and in order to prevent the protective member being moved to its operative position merely as a result of normal operation of the lock, provision must be made to cancel the rotation of the rotary member each time the lock is opened.

Whether the return mechanism starts to operate after each turning movement of the rotary member or only after the protective member has been moved to its operative position, the return movement is preferably achieved by the inclusion of a spring which is progressively stressed as the rotary member is turned, the stress in the spring subsequently serving to return the rotary member to its datum position at a rate determined by an escapement mechanism. In other words, the escapement mechanism determines the time delay before the rotary member once again returns to its datum position.

The operation of the protective member preferably serves to isolate one part of the locking mechanism from another so that operation of the lock is rendered impossible. For example, the protective member may operate to isolate the probe of the lock from the combination wheels. Once the probe is prevented from responding to the settings of the wheels, the operation of the remainder of the lock is rendered impossible. As alternatives, however, the protective member may serve to prevent further dialling once moved to its operative position or it may effectively re-lock the lock in some alternative manner until returned to its inoperative position. In order to isolate the probe of the lock from the combination wheels, the protective member conveniently has an inclined surface which engages the probe with a camming action and thus lifts it from contact with the combination wheels. In one simple form of mechanism the protective member takes the form of a pivoted lever which, in its operative position, obstructs the movement of the probe of the lock, e.g. by means of the camming action just described, and thus prevents the lock from being opened. This lever may be rocked between its inoperative and operative positions by a projection on the rotary member.

BRIEF DESCRIPTION OF THE DRAWING

A construction of lock in accordance with the invention will now be described in more detail, by way of example, with reference to the accompanying drawings, in which.

DETAILED DESCRIPTION OF THE PREFERRED EMBODIMENT

Figure 1:
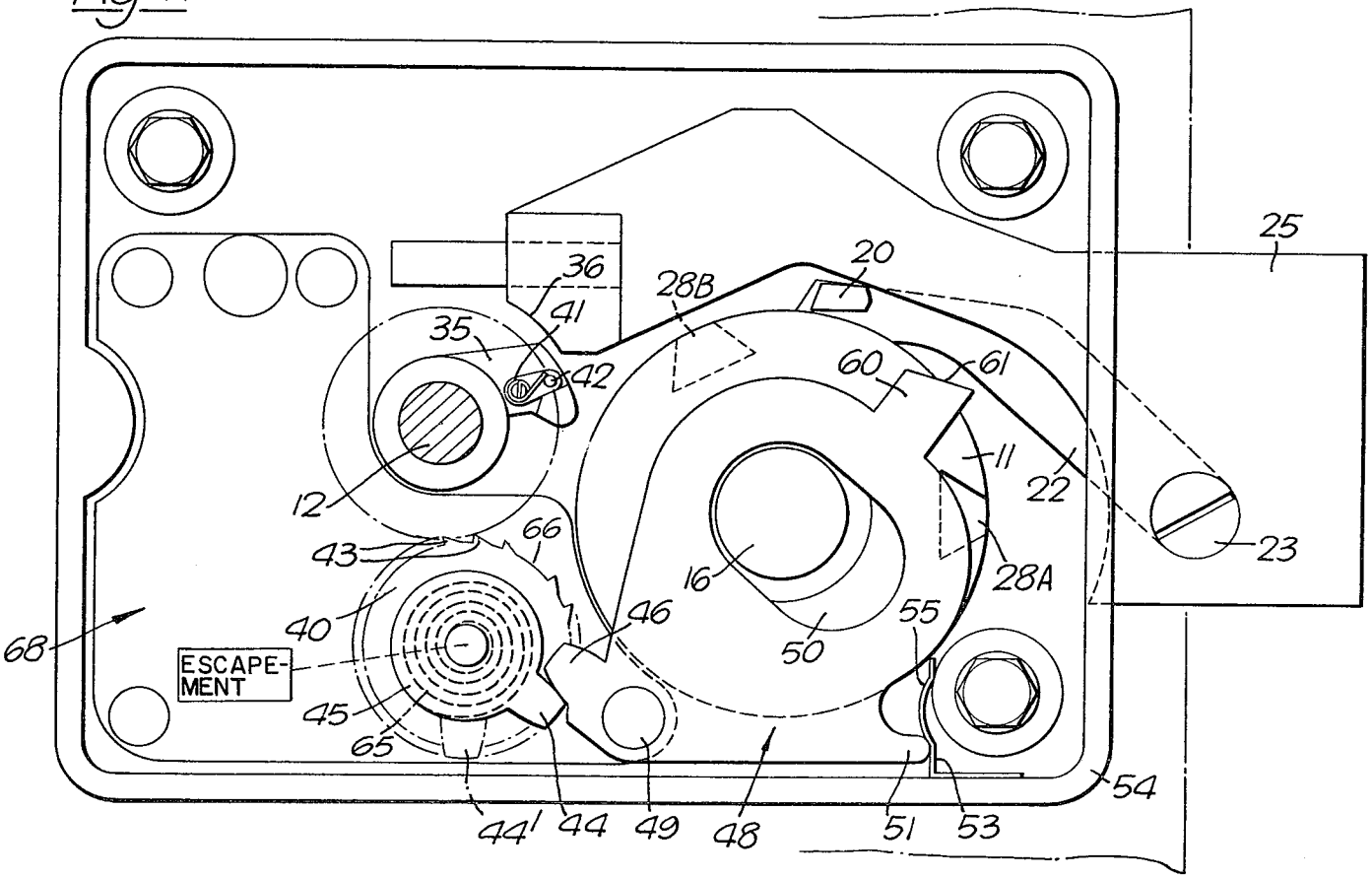
FIG. 1 is an elevation of the lock with a cover removed showing the bolt of the lock in its extended position and a protective member in its inoperative position.
Figure 4:
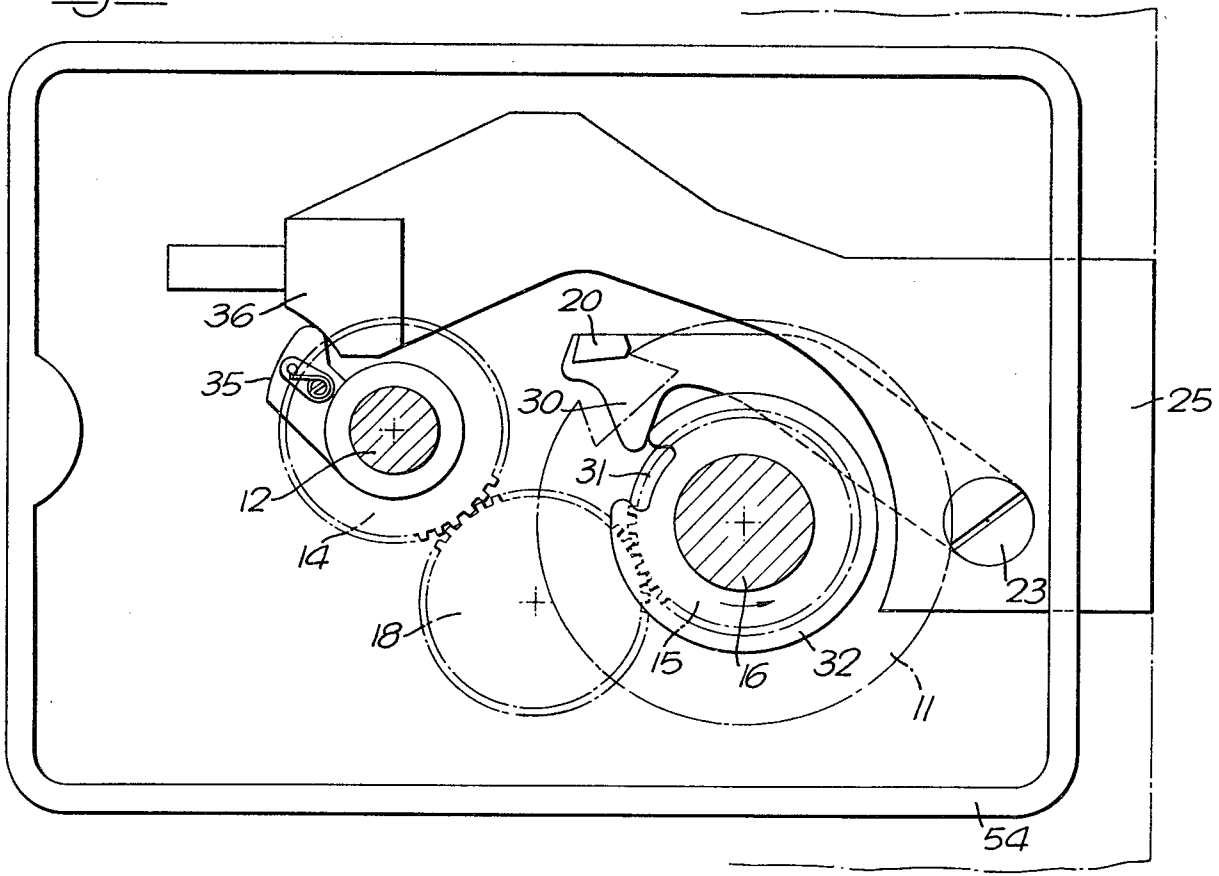

Turning first to FIG. 1, the lock illustrated is of the offset type, that is to say in which the combination wheels 11 are not mounted on the dial spindle 12, but are offset from it and are driven by gearing (seen in FIG. 4) comprising a toothed wheel 14 on the dial spindle 12, a toothed wheel 15 on the spindle 16 of the combination wheels 11 and an intermediate gear wheel 18 meshing with the two gear wheels 14 and 15. A probe 20 is mounted on a drop arm 22 pivoted at 23 to the bolt of the lock, shown as 25. The probe 20 cooperates with a gate 28 in each of the combination wheels in the usual way, the gate in the top wheel being shown as 28A and that in the next wheel as 28B. Any conventional number of combination wheels may be included, the construction illustrated having four such wheels with the gates of only the two top wheels being illustrated. The wheels are driven by the normal lost-motion connections, which are not illustrated and when all the gates 28 have been aligned, the probe 20 may enter the aligned gates and allow the drop arm 22 to fall in the usual way. This allows a nose portion 30 on the drop arm 22 to fall to a position shown in dotted lines as 30' and thus to engage a recess 31 in a driver 32 fixed to the spindle 16. Consequently, further rotation of the dial in an anti-clockwise direction causes rotation of the driver 32 in the same direction, as indicated by the arrow 33, thus moving the nose portion 30 of the drop arm 22 to the left and hence retracting the bolt 25 to the position shown in FIG. 4.

Figure 2:
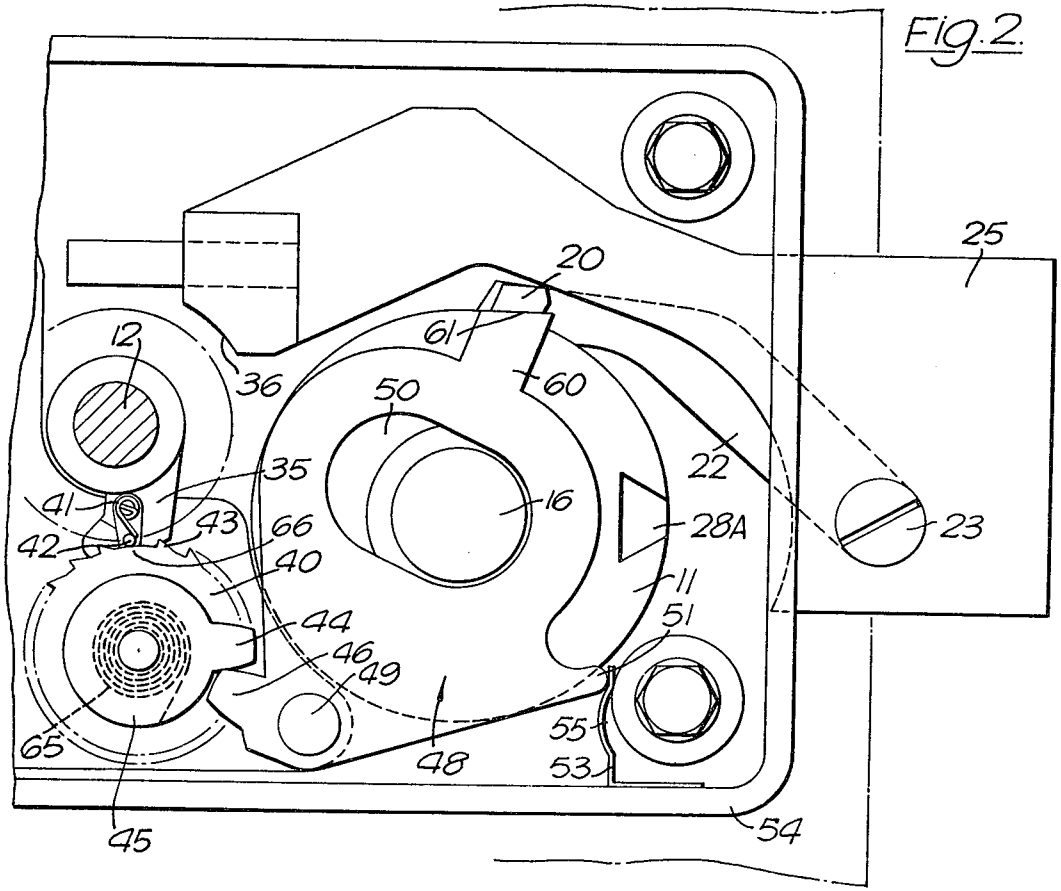
FIG. 2 is a view similar to FIG. 1, but showing the protective member after movement to its operative position.
Figure 3:
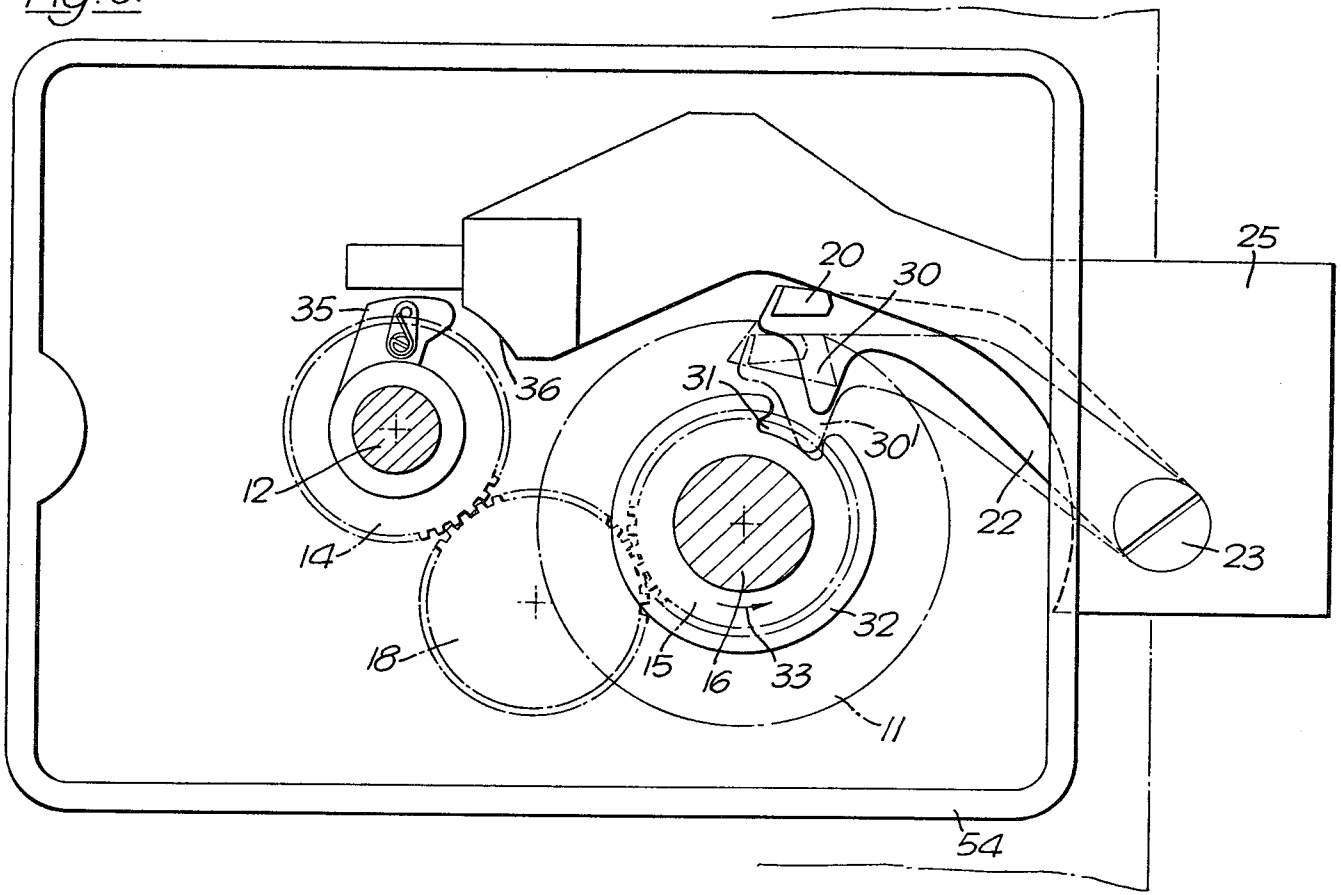
FIG. 3 is a view corresponding to FIG. 2, but with parts removed to show the operation of others; and, FIG. 4 is a view similar to FIG. 3, but showing the lock after operation, with the bolt in its retracted position.

As so far described, the mechanism itself and its operation is entirely standard. Further parts of the standard mechanism include a thrower cam 35 on the dial spindle 12 which normally clears the tail-end of the bolt 25 by virtue of an arcuate portion 36 on the bolt, as seen in FIGS. 1 to 3. When the bolt has been retracted to the position of FIG. 4, as a result of anti-clockwise turning movement of the dial spindle 12, the thrower cam 35 is in the position shown in FIG. 4 in relation to the arcuate portion 36 on the tail of the bolt 25. Consequently, when the dial spindle 12 is turned again in a clockwise direction, the thrower cam 35 engages the tail of the bolt and extends the bolts once again to the position of FIGS. 1 to 3 in which the thrower cam 35 once again clears the arcuate portion 36.

In addition to the standard components so far described, the lock includes a rotary member in the form of a ratchet wheel 40 which is driven from the dial spindle 12 by way of an indexing mechanism shown, by way of example, as comprising a spring-loaded pawl 41 mounted on the thrower 35 so as to be turned by the dial spindle 12. The pawl 41 includes a pin 42 which co-operates with asymmetrical ratchet teeth 43 on the wheel 40 so as to transmit clockwise drive to the wheel 40 (for anti-clockwise rotation of the dial spindle 12) but not anti-clockwise drive. Consequently, manipulation of the dial indexes the wheel 40 in a clockwise direction.

FIG. 1 shows the wheel 40 in a datum position in which a projection 44 on a rotary member 45 turning with the wheel 40 is in engagement with a complementary projection 46 on a protective member constituted by a lever indicated generally as 48. This lever is pivoted at 49 and has a central cutaway portion 50 which enables it to clear the spindle 16 carrying the combination wheels 11. The lever 48 has two alternative positions defined by co-operation between a projection 51 and a leaf-spring 53 fixed to the casing 54 of the lock. The leaf-spring 53 has a convex portion 55 and when the projection 51 is below this portion, it defines an inoperative position of the lever 48 as seen in FIG. 1.

In this inoperative position, a projection 60 on the lever 48 is clear of the probe 20, but if the lever is turned in an anti-clockwise direction from the position of FIG. 1 to that of FIG. 2 until the projection 51 is above the convex portion 55 of the leaf-spring 53, an operative position is defined in which the projection 60 engages the probe 20 so that an inclined surface 61 on the projection 60 engages the probe 20 with a camming action and lifts it clear of the combination wheels 11. The operation whereby the lever 48 is moved between its inoperative and operative positions will now be described in more detail.

As already described, FIG. 1 shows a datum position of the wheel 40, in which the projection 44 is in engagement with the lower side of the projection 46 on the lever 48 and the wheel 40 is urged into this position by a coiled spring 65 which lies behind the wheel 40 and is shown in dotted lines. Rotation of the wheel 40 in a clockwise direction winds up the spring 65 and the spring exerts a permanent torque on the wheel 40 in an anti-clockwise direction.

During a normal opening operation, the dial spindle 12 will turn through several revolutions and, as a consequence, the indexing mechanism will turn the wheel 40 in a clockwise direction, thus moving the projection 44 away from its datum position. An intermediate position of the projection 44 is shown in dotted lines as 44' and represents a typical position which may be taken up as the result of the normal operation of the dial of the lock. As soon as the lock has been opened and the dial is operated no further, the spring 65 takes charge to return the disc 40 to its datum position, the rate of return being controlled by an escapement mechanism which is not illustrated in detail, but is enclosed within a casing indicated as 68. After a normal opening operation, it may, for example, take between one and two hours for the wheel 40 to return to its datum position as illustrated in FIG. 1.

Under conditions of manipulation, however, many more rotations of the dial are necessary, and, as a result, the wheel 40 is turned progressively in a clockwise direction until the projection 44 on the rotary member 45 comes into engagement with the upper side of the projection 46 on the lever 48. Any further rotation in this direction causes the projection 46 to be pressed downwardly, thus producing a turning movement of the lever 48 in an anti-clockwise direction, thus moving the lever from its inoperative position shown in FIG. 1 to its operative position shown in FIG. 2. As can be seen, the projection 44 is bearing against the upper surface of the projection 46 which it has forced downwardly to the position shown. At the same time, the spring 65 has been wound up further as seen by the position of the dotted line. This represents an alternative stable position of the lever 48, in which it is held by engagement between the projection 51 and the leaf-spring 53. In this position, the action of the cam surface 61 has lifted the probe 20 clear of the surfaces of the combination wheels 11 so that, even if the gates 28 are brought into alignment, the probe 20 and hence the drop arm 22 are prevented from falling by the presence of the projection 60. The manipulator can still continue to turn the dial quite freely, but since the probe 20 is held away from the surface of the combination wheels, nothing can be learned from the continued manipulation and it is quite impossible to operate the lock since the retention of the drop arm in its raised position prevents the nose 30 from coming into engagement with the recess 31 and there is thus no possibility of withdrawing the bolt 25.

In this position of the ratchet wheel 40 a gap 66 in the ratchet teeth 43 comes into register with the pawl 41 so that no more drive is transmitted to the wheel 40 and no further pressure is exerted on the projection 46 nor is there any risk of overwinding the spring 65.

As soon as the manipulation stops, the spring 65 starts to turn the wheel 40 in an anti-clockwise direction from the position shown in FIG. 2. The lever 48 remains in its operative position, being held there by engagement of the projection 51 with the leaf-spring 53, and thus serving to hold the probe 20 and hence the drop arm 22 in the raised position. These conditions are maintained during the whole of the time while the wheel 40 is returning to its datum position shown in FIG. 1. During that time, which is controlled by the action of the escapement and which may be, for example, of the order of 10 hours, it is quite impossible for any one, even an authorised operator, to operate the lock. As the rotation of the wheel 40 nears completion, the projection 44 first engages the underside of the projection 46 on the lever 48 and then, as rotation continues under the influence of the spring 65, the projection 46 is moved upwardly, thus turning the lever 48 in a clockwise direction back to its inoperative position as shown in FIG. 1 and thereby enabling the lock to be operated in the normal way again. Generally speaking, therefore, the lock will be operable again by the time that it is required by an authorised operator, but it will be rendered completely inoperative for a sufficient period of time to foil the manipulator.

As mentioned previously, there is a slight risk that the protective member might be operated as the result of legitimate dialling, e.g. if the lock were operated several times in quick succession, or if there were a number of incorrect, possibly careless, diallings. To provide an indication of this impending risk a warning light may be operated by a micro-switch (not shown in the drawing) which is actuated by part of the mechanism shortly before reaching the position of FIG. 2. This provides a warning to the authorised operator to wait a few minutes and then to dial carefully.

I claim:

1. In a combination lock comprising a bolt, a dial, a plurality of co-operating co-axial combination wheels, means for driving said combination wheels from said dial, and means co-operating with said combination wheels for connecting said dial to said bolt when the correct combination has been dialled for operating said lock, the improvement comprising a rotary member rotatable between a datum position and a second position, means turned by rotation of said dial for driving said rotary member from said datum position to said second position responsive to the excessive rotation of said dial characterizing unauthorized operation, a protective member movable between an inoperative position and an operative position for rendering operation of the lock impossible, said protective member being engaged by said rotary member for being placed in said inoperative position when said rotary member is in said datum position and being moved to said operative position when said rotary member is in said second position and means for returning said rotary member to said datum position thereof after a time delay to return said protective member to said inoperative position.

2. A combination lock according to claim 1 including means which permits said return means to start to operate as soon as said rotary member is turned from said datum position thereof.

3. A combination lock according to claim 1 in which said return means includes a spring for returning said rotary member to said datum position, means for progressively stressing said spring as said rotary member is turned from said datum position to said second position and an escapement mechanism for controlling the rate at which said stress in said spring returns said rotary member to said datum position thereof.

4. A combination lock according to claim 1 including at least a pair of bolt operating parts capable of being isolated from one another and means for isolating said parts operatively associated with said protective member.

5. A combination lock according to claim 4 in which said combination wheels are formed with gates and said means co-operating with said combination wheels comprises a probe capable of entering said gates when aligned, said protective member having means for operating said probe from said combination wheels.

6. A keyless combination lock according to claim 5 in which said protective member includes a cam surface, said cam surface co-operating with said probe whereby to produce a camming action for lifting said probe from contact with said combination wheels.

7. A combination lock according to claim 1 in which the protective member comprises a pivoted lever, said rotary member having a projection for engaging said lever to rock said lever between said inoperative and operative positions when said rotary member is in the datum and second positions, respectively.

8. A combination lock according to claim 1 including an indexing mechanism operatively associated with said rotary member for removing the drive from said rotary member when said rotary member is in said second position.

9. In a combination lock comprising a bolt, a dial, a plurality of co-operating co-axial combination wheels, means for driving said combination wheels from said dial, and means co-operating with said combination wheels for connecting said dial to said bolt when the correct combination has been dialled for operating said lock, the improvement comprising an indexing mechanism, means driven by said dial for driving said indexing mechanism, a rotary member rotatable between a datum position and a second position, said rotary member being driven by said indexing mechanism from said datum position to said second position responsive to the excessive rotation of said dial characterizing unauthorized operation of said dial, said indexing mechanism including means for removing drive from said rotary member when said rotary member is in said second position, a protective member, means defining an inoperative position of said protective member and an operative position of said protective member for rendering operation of said lock impossible, said rotary member having a projection engaging said protective member when said rotary member is in the second position to move said protective member from said inoperative position to said operative position, said combination wheels being formed with gates and said means co-operating with said combination wheels comprising a probe capable of entering said gates when said gates are aligned by dialling of the correct combination, said protective member including a cam surface co-operating with said probe to produce a camming action for lifting said probe from contact with said combination wheels when said protective member is in said operative position, and mechanism for returning said rotary member to said datum position thereof after a time delay, said return mechanism including a spring operative to return said rotary member when stressed, means for progressively stressing said spring as said rotary member is turned toward said second position and an escapement mechanism for controlling the rate at which said stress in said spring returns said rotary member to said datum position thereof, said projection on said rotary member engaging said protective member when said rotary member returns to said datum position to return said protective member back to said inoperative position in the event that said protective member has previously been moved to said operative position.

10. In a manipulation-resistant combination mechanism for enabling a controlled operation to be performed conditionally upon entry into the mechanism of a predetermined combination, said mechanism including selectively-releasable control means for enabling said controlled operation, a plurality of rotatably-mounted combination wheels, dial means for entering said combination into said mechanism, said dial means being coupled to the said wheels for rotating the wheels to a predetermined collective setting by successive rotational operations of the said dial means according to said combination, fence means operable to adopt a release condition only when said wheels are in said predetermined setting, said fence means co-operating with said control means to release said control means so as to enable performance of said controlled operation only when said fence means is in said release condition, and selectively-operable disabling means for inhibiting adoption of said release condition by said fence means, the improvement wherein said combination mechanism further includes driveable means for operating said disabling means, said driveable means being driveable from a first, datum state to a second state in which it operates said disabling means so as to inhibit adoption of the said release condition by said fence means, means coupling the said dial means to said driveable means to drive said driveable means progressively from said first state to said second state in response to successive combination-setting rotations of said dial means during manipulation of the dial means, the extent of rotation of the dial means required to drive said driveable means from first state to said second state being greater than that required to rotate the said combination wheels straightforwardly into said predetermined setting, and means operative with a time delay for re-setting said driveable means from its said second state to its said first, datum state.

* * * * *